US005701833A

United States Patent [19]

Suzuki

[11] Patent Number: 5,701,833

[45] Date of Patent: Dec. 30, 1997

[54] METHOD AND APPARATUS FOR SEWING CLOTH PIECES IN A SERIES TO CONTINUOUS SLIDE FASTENER CHAIN

[75] Inventor: Yasutoshi Suzuki, Toyama-ken, Japan

[73] Assignee: YKK Corporation, Tokyo, Japan

[21] Appl. No.: 671,682

[22] Filed: Jun. 28, 1996

[30] Foreign Application Priority Data

Jun. 30, 1995 [JP] Japan ..... 7-164980

[51] Int. Cl.[6] ..... D05B 35/06; D05B 27/16

[52] U.S. Cl. ..... 112/475.16; 112/470.32; 112/113; 112/318

[58] Field of Search ..... 112/475.14, 475.15, 112/475.16, 475.07, 475.09, 304, 307, 312, 318, 322, 112, 470.32, 470.33, 470.03; 414/749, 750; 198/571, 575, 576, 577

[56] References Cited

U.S. PATENT DOCUMENTS 4,362,116 12/1982 Sen Gupta et al. ..... 112/475.14 X
4,421,044 12/1983 Freermann et al. ..... 112/304 X
4,541,352 9/1985 Boser et al. ..... 112/470.03
4,576,104 3/1986 Miyakawa ..... 112/475.15
4,608,745 9/1986 Miyakawa et al. ..... 112/475.16 X
4,611,546 9/1986 Miyakawa .
4,644,886 2/1987 Miyakawa ..... 112/475.16

*Primary Examiner*—Ismael Izaguirre
*Attorney, Agent, or Firm*—Hill, Steadman & Simpson

[57] ABSTRACT

In a sewing station, a preceding cloth piece is sewn to a slide fastener chain from a leading end of the preceding cloth piece to a predetermined position short of a trailing end thereof, and the sewing is terminated when it reaches the predetermined position. On the other hand, in a cloth-piece supply station, a succeeding cloth piece is fed at a high speed toward the sewing station to an upstream position spaced a predetermined distance from the trailing end of the preceding cloth piece while being stopped, whereupon the sewing is started when the leading end of the succeeding cloth piece contacts with or nearly contacts with the trailing end of the preceding cloth piece. As a result, the remaining portion of the preceding cloth piece is sewn. These driving timing is sequentially controlled via a control unit based on various detection signals from a plurality of cloth-piece detectors.

7 Claims, 4 Drawing Sheets

METHOD AND APPARATUS FOR SEWING CLOTH PIECES IN A SERIES TO CONTINUOUS SLIDE FASTENER CHAIN

BACKGROUND OF THE INVENTION

1. Field of the Invention

This invention relates to a method of and an apparatus for automatically sewing a plurality of cloth pieces, which are to be used in an opening of a garment, such as a front fly of trousers, a body of a one-piece dress and a cloth piece of a skirt, successively in order and in a nearly contacted fashion to a continuous slide fastener chain.

2. Description of the Related Art

An apparatus for automatically sewing a plurality of front flies one after another to a continuous slide fastener chain is disclosed in, for example, Japanese Patent Publication No. Sho 63-9878 (U.S. Pat. No. 4,576,104). According to this Japanese Publication, the cloth-piece supply mechanism for feeding the cloth pieces to the sewing station includes a plurality of sets of upper and lower supply rollers, i.e. driven supply rollers and pressing rollers, for feeding the cloth pieces as lightly sandwiched between the driven supply rollers and pressing rollers. The driven roller on the downstream side has a speed of rotation slightly higher than the sewing speed, while the driven roller on the upstream side has a speed of rotation higher than that of the driven roller on the downstream side. The pressing force under which the cloth pieces are to be resiliently pressed against each driven roller by the associated presssing roller is set to a minimum required for feeding.

As the cloth pieces are successively supplied to a cloth-piece supply station, a leading end of the succeeding cloth piece rapidly comes near and then into contact with a trailing end of a preceding cloth piece which is being sewn to the continuous slide fastener chain. However, since the resiliently pressing force against the cloth pieces by the press rollers is relatively small, the force of feeding the cloth pieces by the upper and lower roller pairs is equal to or smaller than a reaction to be exerted on the trailing end of the preceding cloth piece so that the cloth pieces can be sewn successively in order to the continuous slide fastener chain in an end-to-end fashion so as that the succeeding cloth piece can not slip on the driven rollers to overlap the preceding cloth piece.

However, with the conventional cloth-piece supply mechanism, although a hard and thick cloth, such as denim can slip between the pressing roller and the driven roller, a soft and thin cloth cannot surely slip between the pressing roller and the driven roller so that a succeeding cloth piece tends to over-run, thus making confronting ends of the adjacent cloth pieces easy to bend or overlap. The resulting product would be unmarketable. If the resilient pressing force between the pressing roller and the driven roller is small, it is impossible to feed the successive cloth pieces reliably so that the waste portion of the slide fastener chain would be on the increase.

SUMMARY OF THE INVENTION

It is therefore an object of this invention to provide a method of and an apparatus for automatically sewing cloth pieces, which have a wide selection in shape and function regardless of the hardness and thickness, to a continuous slide fastener chain exactly in an end-to-end series.

According to a first aspect of this invention, the above object is accomplished by a method of automatically sewing a plurality of cloth pieces orderly in a series to a continuous slide fastener chain, comprising the steps of: continuously supplying the continuous slide fastener chain to a sewing station in synchronism with a sewing speed; sewing, in the sewing station, to the slide fastener chain a preceding cloth piece from its leading end to a predetermined position short of its trailing end and interrupting the sewing when it reaches the predetermined position; feeding, in a cloth-piece supply station, a succeeding cloth piece at a high speed toward the sewing station to a position spaced a predetermined distance upstream of the trailing end of the preceding cloth piece while the sewing is interrupted, and then feeding the succeeding cloth piece at a low speed until a leading end of the succeeding cloth piece comes into contact with the trailing end of the preceding cloth piece; and sewing the remaining portion of the preceding cloth piece as started in response to that the leading end of the succeeding cloth piece has come into contact with the trailing end of the preceding cloth piece while being interrupted.

According to a second aspect of the invention, the above object is accomplished by an apparatus for automatically sewing a plurality of cloth pieces orderly in a series to a continuous slide fastener chain, comprising: a sewing station having sewing means; supply means for continuously supplying the slide fastener chain toward the sewing station in synchronism with the sewing; a cloth-piece supply station situated upstream of a sewing line of the sewing station for successively supplying a plurality of cloth pieces; a central control unit; the cloth-piece supply station having a high-speed feed region at an upstream position, a low-speed feed region at an intermediate position, and a sewing-speed feed region at a downstream position where the cloth pieces are to be fed at a speed equal to the sewing speed in the sewing station; first, second and third cloth-piece detecting means being situated in the respective feed regions; the first cloth-piece detecting means having a function of detecting a leading end of each of the cloth pieces to feed the cloth piece at a high speed in the high-speed feed region by high-speed feeding means via the central control unit; the second cloth-piece detecting means having a function of detecting a leading end of each of the cloth pieces, which is being fed at a high speed, to feed the cloth piece at a low speed in the low-speed feed region by low-speed feeding means via the central control unit and detecting a trailing end of the cloth piece to stop the sewing means via the central control unit after a lapse of a predetermined time; and the third cloth-piece detecting means having a function of detecting that a leading end of a succeeding cloth piece contacts with or nearly contacts with a trailing end of a preceding cloth piece while the feeding of the preceding cloth piece is interrupted, and starting the sewing means, and at the same time, feeding the succeeding cloth piece at a sewing speed by a sewing-speed feeding means.

Preferably, the low-speed feeding means in the low-speed feed region has a driven supply roller to be rotated at a predetermined speed and a pressing supply roller to be pressed against and moved away from the driven supply roller with the cloth pieces therebetween, the low-speed feed means being operable to alternately raise and lower the pressing supply roller for feeding the cloth piece at a low speed. Alternatively, the low-speed feeding means in the low-speed feed region has a driven supply roller to be rotated at a predetermined low speed and a pressing supply roller to be pressed against and moved away from the driven supply roller with the cloth pieces therebetween, the low-speed feeding means being operable to intermittently press the pressing supply roller against the driven supply roller via the cloth pieces.

Further, the second cloth-piece detecting means and the third cloth-piece detecting means are spaced apart from each other by such an adequate distance that the trailing end of the succeeding cloth piece enters a detecting range of the third cloth-piece detecting means after the lapse of the predetermined time from an output of a sewing-means stopping signal when the trailing end of the succeeding cloth piece is detected by the second cloth-piece detecting means. Further preferably, the first and second cloth-piece detecting means has a spot detection range, and the third cloth-piece detecting means has such an adequate detection range as to detect the trailing end of the preceding cloth piece and the leading end of the succeeding cloth piece simultaneously. During the lapse of the predetermined time, the number of sewing stitches of the preceding cloth piece is counted by, for example, a counter so that the sewing of the stitches whose number is within a predetermined range is terminated.

Since the succeeding cloth piece is fed at a high speed immediately after thrown into the apparatus and then at a low speed near the third cloth-piece detector, it is possible to improve the operating efficiency of the apparatus and to prevent the succeeding cloth piece while being interrupted from overlap the preceding cloth piece or to prevent the adjacent two cloth pieces from being bent.

Further, the feed-speed switching timing and the control timing while the individual cloth piece is being fed is controlled by a sequence control program of the central control unit, based on the cloth-piece-end detection signals from the first, second and third cloth-piece detecting means respectively disposed in the high-speed feed region, the low-speed feed region and the sewing-speed feed region.

DETAILED DESCRIPTION OF THE PREFERRED EMBODIMENTS

Figure 1:
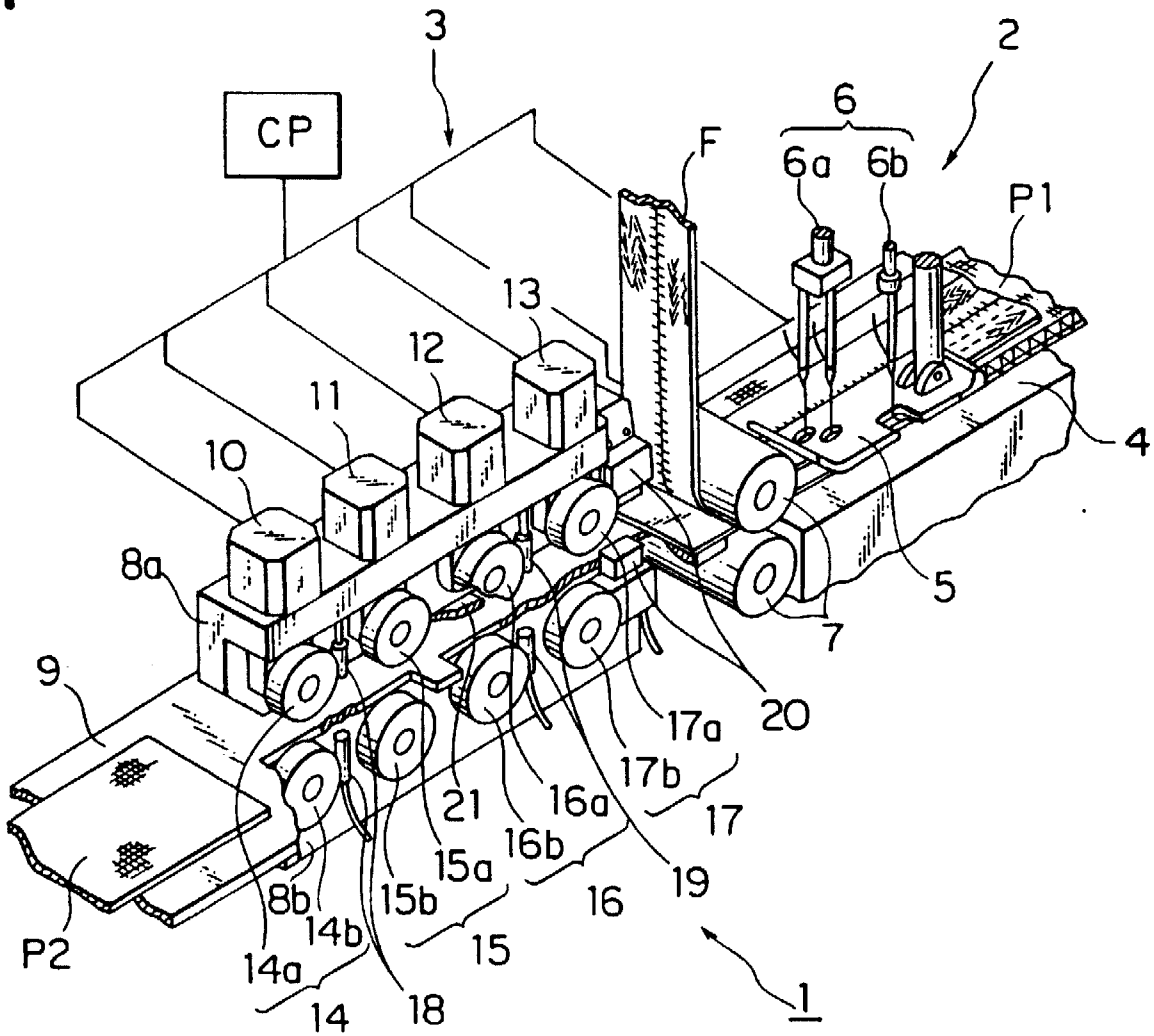
FIG. 1 is a perspective view, with parts broken away, of a cloth-piece sewing apparatus according to a typical embodiment of this invention.

Preferred embodiments of this invention will now be described below in detail with reference to the accompanying drawings. FIG. 1 shows the main part of an apparatus 1 for successively and efficiently sewing a plurality of cloth pieces P to a continuous slide fastener chain F in an end-to-end series. The sewing apparatus 1 comprises a sewing station 2, and a cloth-piece supply station 3 for automatically supplying a plurality of cloth pieces P to the sewing station 2. The cloth pieces P are fed to the supply station 3 intermittently at irregular intervals.

The sewing station 2 has a commercially available industrial sewing machine, which has a sewing machine table 4 for supporting and guiding the cloth pieces P to be sewn, a pressure foot 5, a pair of sewing needles 6*a* for sewing the cloth pieces P to the fastener chain F, an edge-overcasing needle 6*b*, a non-illustrated feed member. The continuous slide fastener chain F is intermittently supplied to the needles 6*a*, 6*b* from a non-illustrated reel, which is supported in an upper part of the sewing station 2, through a space between the sewing machine table 4 and the pressure foot 5 by a vertical pair of supply rollers 7, together with the cloth pieces P. The supply rollers 7 are driven for rotation at a speed equal to the sewing speed in synchronism with the driving of the feeding member via, for example, a timing belt. If it is unnecessary to overcast the cloth pieces P, the overcasting binding needle 6*b* may be removed.

The cloth-piece supply station 3 has a cloth-piece supply table 9 disposed on an upstream side of the sewing station 2 via the supply rollers 7, an inverted L-shape frame 8*a* projecting upwardly from the supply table 9, first–fourth air cylinders 10–13 mounted on the frame 8*a* in a longitudinal row, first–fourth pressing supply rollers 14*a*–17*a* attached to the respective rod ends of the individual air cylinders 10–13, first-fourth driven supply rollers 14*b*–17*b* supported on driven shafts via a lower frame 8*b* in confronting relationship with the first–fourth pressing supply rollers 14*a*–17*a* with the cloth-piece supply surface between them, a first cloth-piece detector 18 disposed between the first and second cloth-piece supply roller pairs, 14, 15, a second cloth-piece detector 19 disposed between the third and fourth cloth-piece roller pairs 16, 17, and a third cloth-piece detector 20 disposed between the fourth cloth-piece supply roller pair 17 and the supply rollers 7. In this invention, an oil-pressure cylinder may be substituted for the air cylinder 10–13.

The respective drive sources for the sewing machine, the supply rollers 7, the first–fourth air cylinders 10–13 and the first–fourth driven supply rollers 14*b*–17*b* are directly or indirectly connected to the central control unit CP and are sequentially controlled according to commands from the central control unit CP upon receipt of detection signals from the first–third detectors 18–20. In the central control unit CP of this embodiment, the sequence control of one cycle of sewing a cloth piece P to the slide fastener chain F is programmed for, based on detection signals from the first–third detectors 18–20, starting/stopping the sewing machine at a predetermined timing, controllably driving the supply rollers 7 and controllably actuating the first–fourth air cylinders 10–13. Usually the first–fourth driven supply rollers 14*b*–17*b* are continuously driven for rotation during the sewing operation; alternatively, they may be intermittently driven in synchronism with the actuation timing of the first–fourth air cylinders 10–13.

In this embodiment, the high-speed feed region HT is a region where the cloth piece P is to be fed by the first and second cloth-piece supply roller pairs 14, 15, the low-speed feed region LT is a region where the cloth piece P is to be fed by the third cloth-piece supply roller pair 16, and the sewing-speed feed region ST is a region where the cloth piece P is to be fed by the fourth cloth-piece supply roller pair 17. According to this embodiment, the feeding-speed ratio of the first, second and third cloth-piece supply roller pairs 14, 15, 16 is 2.5:2.5:1, and the feeding speed of the fourth cloth-piece supply roller pair 17 is equal to that of the feeding speed of the supply rollers 7, which is equal to the sewing speed. The first–fourth driven supply rollers 14b–17b are 25 mm in diameter, the first and second driven supply rollers 14b, 15b are 200 rpm in rotational speed, and the third driven supply roller 16b is 80 rpm in rotational speed. The sewing speed is 4000 rpm. Of course, this invention should by no means be limited to these values. The number of cloth-piece supply roller pairs also should not be limited to that of the illustrated example; for example, the second cloth-piece supply roller pair 15 may be omitted, in which case the first cloth-piece detector 18 is disposed between the first and third cloth-piece supply roller pairs 14, 16.

Using a plurality of cloth-piece supply roller pairs, the high-speed feed region HT and the low-speed feed region LT serve to feed the cloth piece P at a high speed immediately after the cloth piece P is thrown into the cloth-piece supply station 3, and then to feed the cloth piece P at a low speed near the third cloth-piece detector 20, thus improving the working efficiency of the apparatus and preventing the succeeding cloth piece P2 from overlapping the preceding cloth piece P1 while being stopped and also preventing such adjacent two cloth pieces from bending individually. Since the feeding-speed ratio of the high-speed feed region HT and the low-speed feed region LT must be set 2.5:1 considering the machine space, the third air cylinder 12 is intermittently vertically actuated during the feeding of the cloth pieces so that the cloth piece P is alternately pressed against and released from the third driven supply roller 16b by the third pressing supply roller 16a and is thereby intermittently fed at a reduced speed.

Of course, assuming that the third driven supply roller 16b can be rotated directly at such a low speed as to satisfy the feeding-speed ratio required to the high-speed feed region HT and the low-speed feed region LT, the third air cylinder 12 is intermittently actuated in the expanding direction during the rotation of the third supply roller pair 16 to continuously press the third pressing supply roller 16a against the third driven supply roller 16b via the cloth piece P, thereby feeding the cloth piece P at a required low speed.

In this embodiment, a cloth-piece pressure pad 21 in the form of a leaf spring is disposed between the second and third cloth-piece supply roller pairs 15, 16 to prevent the cloth piece P from overrunning during the high-speed feeding.

The controlled driving of the first–third driven supply roller pairs 14–16 are made by way of detecting the ends of the cloth pieces P by the first–third cloth-piece detectors 18–20.

FIGS. 2 through 6 shows the cloth-piece supply procedure of the cloth-piece supply station 3 according to this embodiment. In this embodiment, while the apparatus is in operation, the first–third driven supply rollers 14b–16b are continuously rotated normally at the above-mentioned set speed, and the feeding of the cloth piece P is controlled by the first–third air cylinders 10–12, and the fourth driven supply roller 17b is alternately rotated and stopped at a predetermined timing in synchronism with the sewing speed of the sewing machine.

Figure 2:
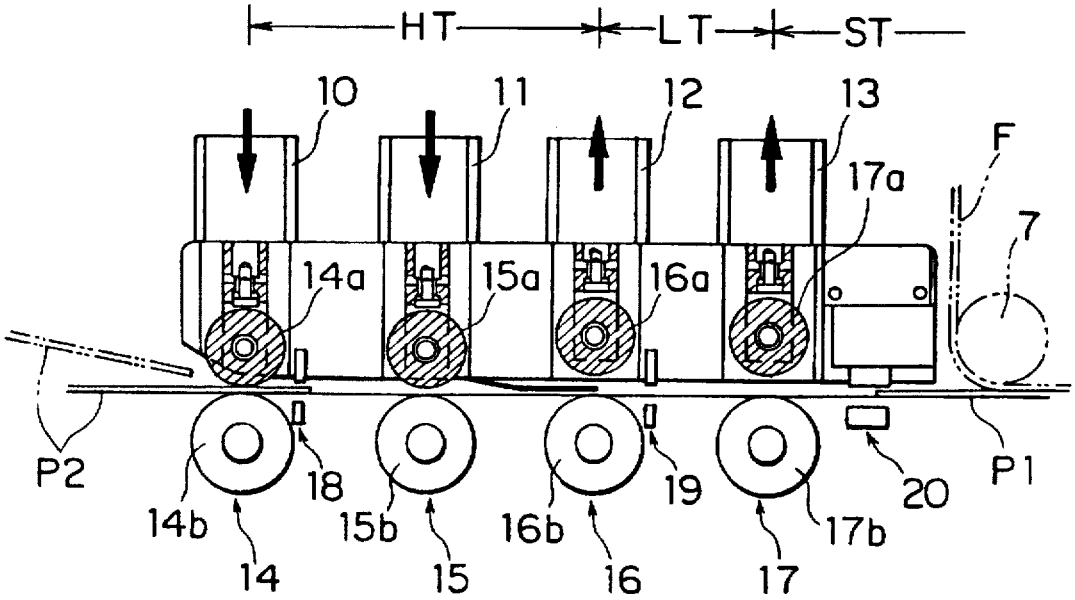
FIG. 2 is a diagram showing the cloth-piece sewing apparatus when a cloth piece has thrown into a cloth-piece supply station.

In FIG. 2, as the sewing of the sewing machine is stopped, the trailing end of a preceding cloth piece P1 is located within the detecting range of the third cloth-piece detector 20, and a succeeding cloth piece P2 is thrown into the first supply roller pair 14. At that time, all of the first-fourth air cylinders 10–13 assume a shrunk posture, and therefore, the first–fourth pressing supply rollers 14a–17a are located at their upper limit positions away from the first–fourth driven supply rollers 14b–17b as indicated by arrows.

When the leading end of the succeeding cloth piece P2, which is thrown into the first supply roller pair 14, is detected by the first cloth-piece detector 18 as shown in FIG. 2, its detection signal is sent to the central control unit CP. Upon receipt of a command signal from the central control unit CP, the first and second air cylinders 10, 11 are actuated to expand so that the first and second pressing supply rollers 14a, 15a press the cloth piece P2 against the first and second driven supply rollers 14b, 15b to feed the cloth piece P2 toward the third supply roller pair 16 at a high speed.

Figure 3:
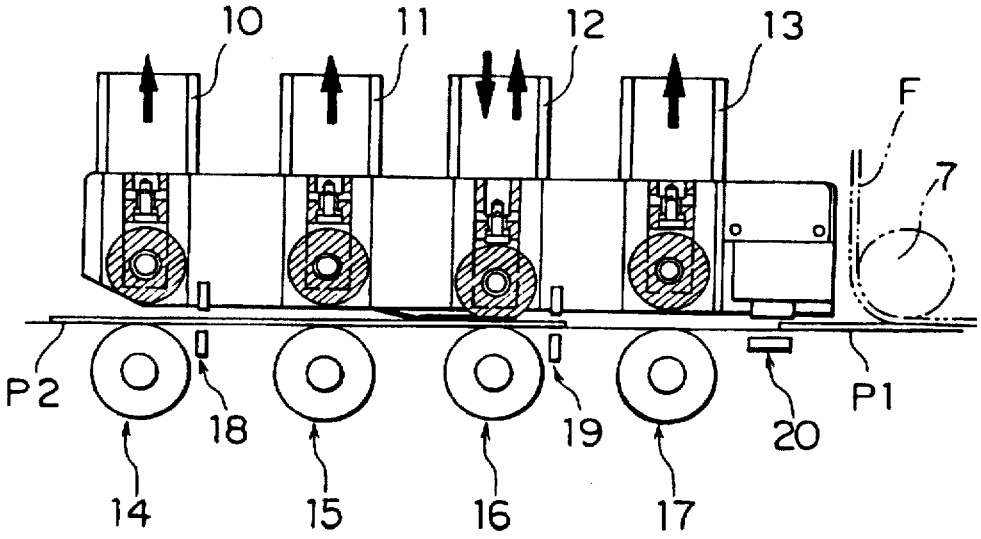
FIG. 3 is a diagram showing the apparatus when the leading end of a succeeding cloth piece has been detected by a second cloth-piece detector.

Then, as shown in FIG. 3, when the leading end of the succeeding cloth piece P2 is detected by the second cloth-piece detector 19 as the succeeding cloth piece P2 fed at a high speed reaches the third supply roller pair 16, the first and second air cylinders 10, 11 are actuated to shrink by the command from the central control unit CP and, at the same time, the third air cylinder 12 is actuated to expand by the same command, so that the first and second pressing supply rollers 14a, 15a are moved away from the first and second driven supply rollers 14b, 15b and, at the same time, the third pressing supply roller 16a is lowered to press the cloth piece P2 against the third driven supply roller 14b, then feeding the cloth piece P2 at a low speed.

According to this embodiment, as an actuation signal is issued from the central control unit CP to the third air cylinder 12 as mentioned above, the air cylinder 12 alternately shrinks and expands at a slight time interval until the leading end of the cloth piece P2 reaches the detection range of the third cloth-piece detector 20, so that the third pressing supply roller 16a are alternately pressed against and released from the third driven supply roller 16b via the succeeding cloth piece P2, so as to feed the cloth piece P2 at a lower speed. In this embodiment, the up-and-down movement of the pressing supply roller 16a is performed in a cycle of 0.03–0.05 sec.; this invention should by no means be limited to these values. If the low-speed driving required to the third supply roller pair 16 is directly realized, the third pressing supply roller 16a is continuously pressed against the third driven supply roller, 16b during the driving of the third supply roller pair 16, so as to continuously feed the succeeding cloth piece P2 at a required low speed.

Figure 4:
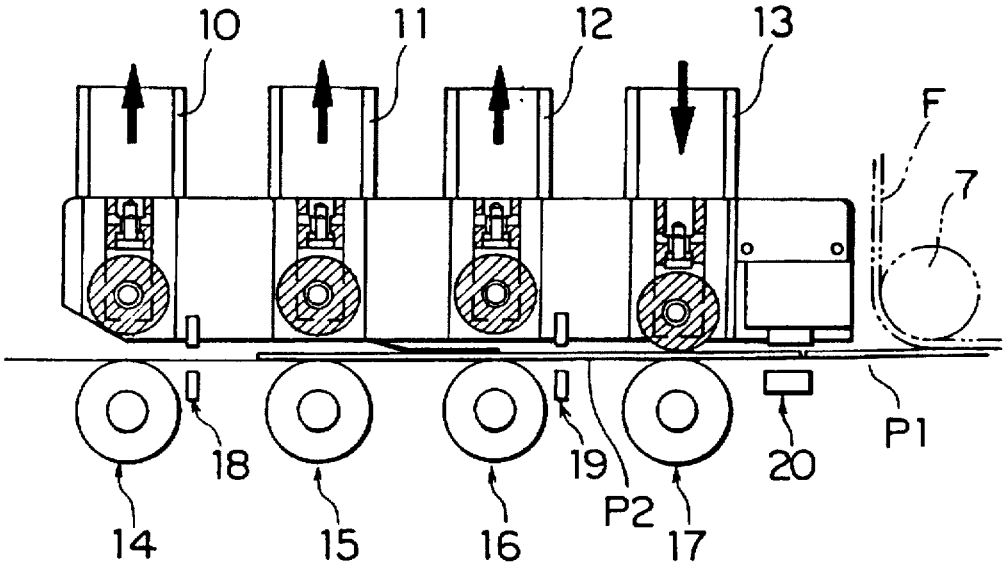
FIG. 4 is a diagram showing the apparatus when the leading end of the succeeding cloth piece has come into contact with the trailing end of a preceding cloth piece.

As shown in FIG. 4, when the leading end of the succeeding cloth piece P2 coming to contact with the trailing end of the preceding cloth piece P1, which is stopped, is detected by the third cloth-piece detector 20 as the leading end of the succeeding cloth piece P2 being at a low speed enter the detection range of the third cloth-piece detector 20, the central control unit CP terminates, upon receipt of a detection signal from the detector 20, the shrinking actuation of the third air cylinder 12 and issues a signal stopping the actuation of the third air cylinder 12 upon confirmation that the third pressing supply roller 14a is moved away from the third driven supply roller 14b. At the same time, the central control unit CP issues an actuation signal actuating the fourth air cylinder 13 to expand and an acutation signal starting the sewing machine so that the fourth supply roller pair 17 is driven, thereby sewing the remaining portion of the preceding cloth piece P1 to the slide fastener chain F and feeding the succeeding cloth piece P2 at the sewing speed, as shown in FIG. 4.

Figure 5:
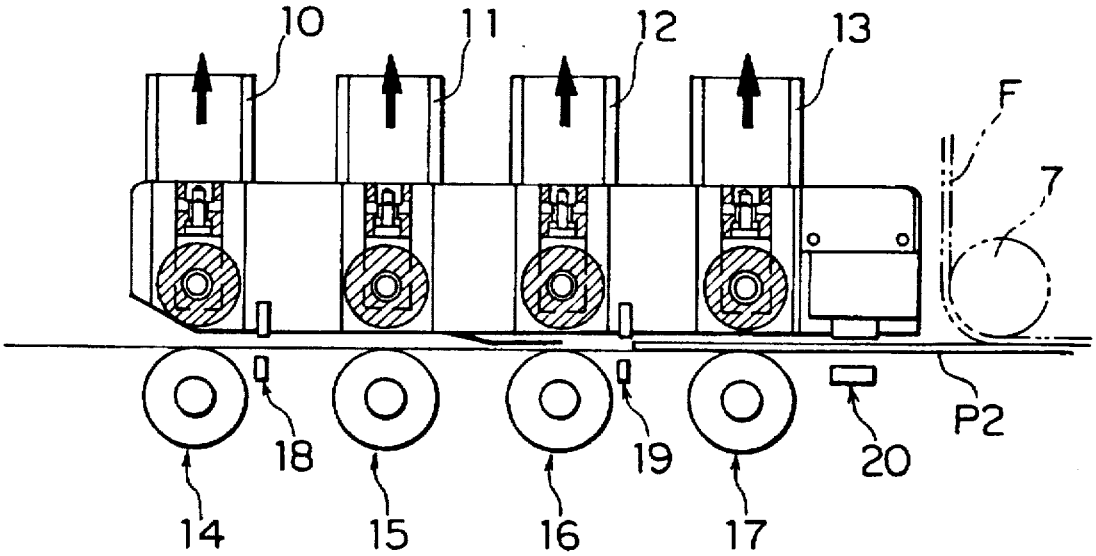
FIG. 5 is a diagram showing the apparatus when the trailing end of the preceding cloth piece has reached the second cloth-piece detector.
Figure 6:
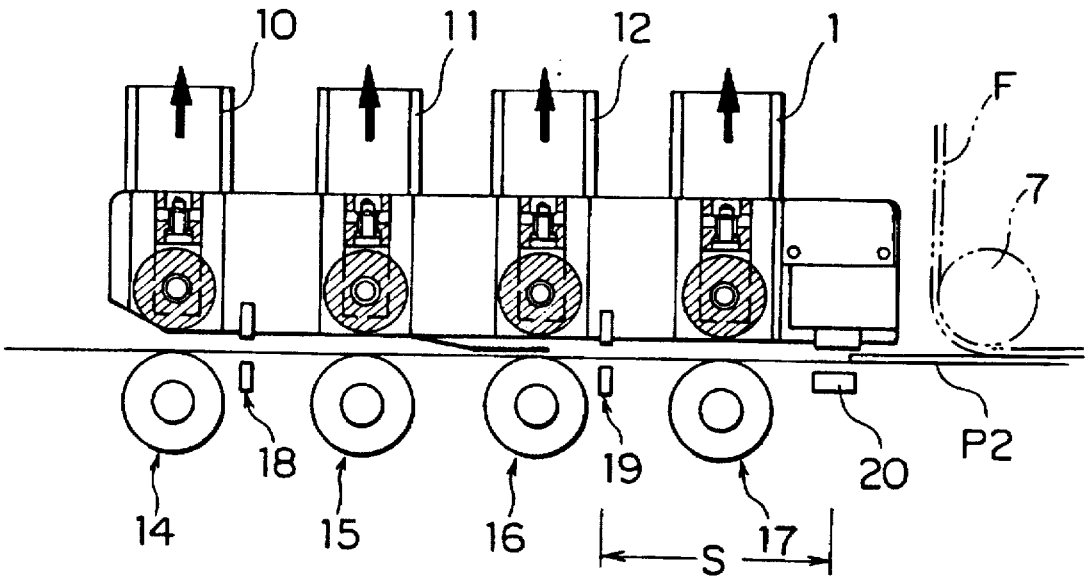
FIG. 6 is a diagram showing the apparatus when the trailing end of the succeeding cloth piece has reached a third cloth-piece detector.

The succeeding cloth piece P2 being fed at the sewing speed joins and is sewn to the slide fastener chain F following to the preceding cloth piece P1, which has already been sewn to the slide fastener chain F. When the trailing end of the succeeding cloth piece P2 being thus fed at the sewing speed reaches the second cloth-piece detector 19 as shown in FIG. 5, the central control unit CP, upon receipt of the detection signal, issues a signal to stop the sewing machine; the sewing machine then stops after a lapse of predetermined time without stopping. Consequently, in this embodiment, considering this delay time, a predetermined time is set enough to form a predetermined number of sewing stitches, which is more than that of sewing stitches during the delay time. This predetermined time may be defined as a time to be measured by a timer after the sewing-machine stopping command signal has been issued, or may be defined, in terms of the predetermined number of needle motions counted by a counter, as such a time that the resulted number of counting exceeds a predetermined value. The second and third cloth-piece detectors 19, 20 are spaced a predetermined distance S from each other in such a manner that the sewing machine will not be stopped until after the predetermined time laspes, whereupon the leading end of the succeeding cloth piece P2 will enter the detection range of the second cloth-piece detector 19, which detects that the leading end of the succeeding cloth piece P2 comes into contact with or nearly contacts with the trailing end of preceding cloth piece P1, irrespective of the delay time, as shown in FIG. 6. Accordingly, the lapse of predetermined time is, according to this invention, a lapse of time from when the sewing-machine stopping signal is issued until when a predetermined number of sewing stitches are formed.

However, considering that the stop position of the trailing end of the succeeding cloth piece P2 varies slightly and that the end-to-end joint of this succeeding cloth piece P2 with a non-illustrated next succeeding cloth piece P should always be detected surely, the detection range of the third cloth-piece detector 20 is set about 10 mm in length in the feeding direction. On the other hand, the first and second cloth-piece detectors 18, 19 should only detect the ends of the cloth pieces P as spot detections. In this embodiment, for each cloth-piece detector, a photoelectric sensor composed of a light projector and a light interceptor disposed one on each of opposite sides of the traveling path of the cloth piece P is used. Alternatively a different type detector may be used.

As decribed above, the phrase "contact with", which is also used in the claims, includes a meaning of "nearly contact with".

Figure 7:
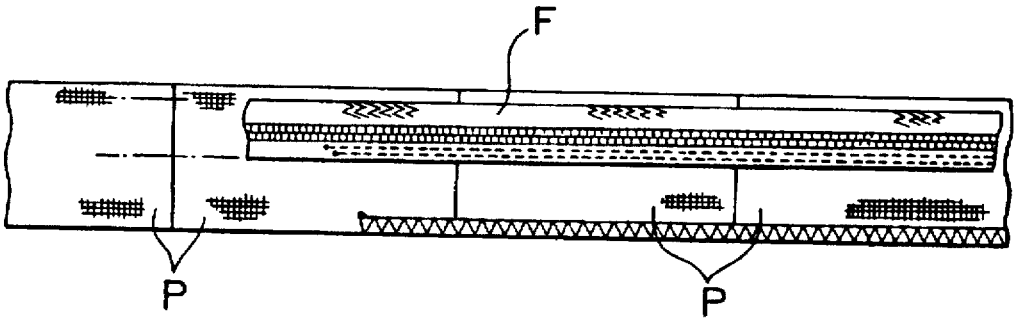
FIG. 7 is a plan view of a part of a sewn product in which a plurality of cloth pieces have been sewn in an end-to-end series to a continuous slide fastener chain.

As the foregoing procedure is repeated, a plurality of cloth pieces P are successively sewn to a continuous slide fastener chain F orderly in an end-to-end series. The resulting product is shown in FIG. 7.

As is apparent from the foregoing description, according to the method and apparatus of this invention, a plurality of cloth pieces, irrespective of the hardness and thickness, can be reliably and efficiently to a continuous slide fastener chain F orderly in an end-to-end series, thus preventing the adjacent cloth pieces from bending or overlapping due to the shape and quality.

What is claimed is:

1. A method of automatically sewing a plurality of cloth pieces orderly in a series to a continuous slide fastener chain, comprising the steps of:

(a) continuously supplying the continuous slide fastener chain to a sewing station in synchronism with a sewing speed;

(b) sewing, in the sewing station, to the slide fastener chain a preceding cloth piece from a leading end of said preceding cloth piece to a predetermined position short of a trailing end thereof and interrupting the sewing at the predetermined position;

(c) feeding, in a cloth-piece supply station, a succeeding cloth piece at a high speed toward said sewing station to a position spaced a predetermined distance upstream of the trailing end of said preceding cloth piece while the sewing is interrupted, and then feeding said succeeding cloth piece at a low speed until a leading end of said succeeding cloth piece comes into contact with the trailing end of said preceding cloth piece; and (d) sewing a remaining portion of said preceding cloth piece as started in response to that the leading end of said succeeding cloth piece has come into contact with the trailing end of said preceding cloth piece while the sewing is interrupted.

2. An apparatus for automatically sewing a plurality of cloth pieces orderly in a series to a continuous slide fastener chain, comprising:

(a) a sewing station having sewing means;

(b) supply means for continuously supplying the slide fastener chain toward said sewing station in synchronism with the sewing;

(c) a cloth-piece supply station situated upstream of a sewing line of said sewing station for successively supplying a plurality of cloth pieces;

(d) a central control unit;

(e) said cloth-piece supply station having a high-speed feed region at an upstream position, a low-speed feed region at an intermediate position, and a sewing-speed feed region (ST) at a downstream position where the cloth pieces are to be fed at a speed equal to a sewing speed in said sewing station;

(f) first, second and third cloth-piece detecting means being situated in the respective feed regions;

(g) said first cloth-piece detecting means having a function of detecting a leading end of each of the cloth pieces to feed the cloth piece at a high speed in said high-speed feed region by high-speed feeding means via said central control unit;

(h) said second cloth-piece detecting means having a function of detecting a leading end of each of the cloth pieces, which is being fed at a high speed, to feed the cloth piece at a low speed in said low-speed feed region by low-speed feeding means via said central control unit and detecting a trailing end of each of the cloth pieces to stop said sewing means via said central control unit after a lapse of a predetermined time; and (i) said third cloth-piece detecting means having a function of detecting that a leading end of a succeeding cloth piece contacts with a trailing end of a preceding cloth piece, while the feeding of the preceding cloth piece is interrupted, and starting said sewing means, and at the same time, feeding the succeeding cloth piece at a sewing speed by sewing-speed feeding means.

3. An apparatus according to claim 2, wherein said low-speed feeding means in said low-speed feed region has a driven supply roller to be rotated at a predetermined speed and a presssing supply roller to be pressed against and moved away from said driven supply roller with the cloth piece therebetween, said low-speed feed means being operable to alternately raise and lower said pressing supply roller for feeding the cloth piece at a low speed.

4. An apparatus according to claim 2, wherein said low-speed feeding means in said low-speed feed region has a driven supply roller to be rotated at a predetermined low speed and a pressing supply roller to be pressed against and moved away from said driven supply roller with the cloth piece therebetween, said low-speed feeding means being operable to intermittently press said pressing supply roller against said driven supply roller via the cloth piece.

5. An apparatus according to claim 2, wherein said second cloth-piece detecting means and said third cloth-piece detecting means are spaced apart from each other by such a distance that the trailing end of said succeeding cloth piece enters a detecting range of said third cloth-piece detecting means after the lapse of said predetermined time from an output of a sewing-means stopping signal when the trailing end of said succeeding cloth piece is detected by said second cloth-piece detecting means.

6. An apparatus according to claim 2 or 5, wherein during the lapse of said predetermined time, said preceding cloth piece is sewn by a number of stitches within a preset range.

7. An apparatus according to claim 5, wherein said first and second cloth-piece detecting means has a spot detection range, and said third cloth-piece detecting means has such a detection range as to detect the trailing end of said preceding cloth piece and the leading end of said succeeding cloth piece simultaneously.

* * * * *